United States Patent [19]

Lapp

[11] 4,025,281

[45] May 24, 1977

[54] METHOD AND APPARATUS FOR FLARING COMBUSTIBLE WASTE GASES

[75] Inventor: Ken O. Lapp, Calgary, Canada

[73] Assignee: Westech Industrial Ltd., Calgary, Canada

[22] Filed: Aug. 8, 1975

[21] Appl. No.: 603,167

[52] U.S. Cl. ..... 431/5; 23/277 C; 431/192; 431/202; 431/278; 431/346

[51] Int. Cl.[2] ..... F23D 13/20

[58] Field of Search ..... 431/5, 202, 284, 285, 431/278, 346, 191, 192; 23/277 C

[56] References Cited

UNITED STATES PATENTS

| | | | |
|---|---|---|---|
| 2,648,376 | 8/1953 | Schrader | 431/202 |
| 2,661,798 | 12/1953 | Clevenger et al. | 431/202 |
| 2,830,658 | 4/1958 | Smith | 431/202 |
| 3,822,985 | 7/1974 | Straitz | 431/284 |
| 3,833,336 | 9/1974 | Ray | 431/202 |
| 3,932,111 | 1/1976 | Liknes et al. | 431/202 |

*Primary Examiner*—Edward G. Favors
*Attorney, Agent, or Firm*—Shlesinger, Arkwright, Garvey & Dinsmore

[57] ABSTRACT

Apparatus for flaring combustible waste gases from oil refineries and the like including a vertical flare stack, a continuously burning pilot burner mounted adjacent the flare stack and a temporary flame retention burner mounted in close proximity to the pilot burner. The pilot burner is provided with a venturi for producing a combustible air-gas mixture and a spark producing device which ignites the combustible mixture in the burner thereby producing a flame front which travels to the top of the burner and ignites the temporary flame retention burner. After the spent gas has been purged from the pilot burner by continuing to flow combustible gas therethrough, the pilot burner is reignited by the flame retention burner, the latter then being extinguished by shutting off its supply.

11 Claims, 7 Drawing Figures

Fig.4
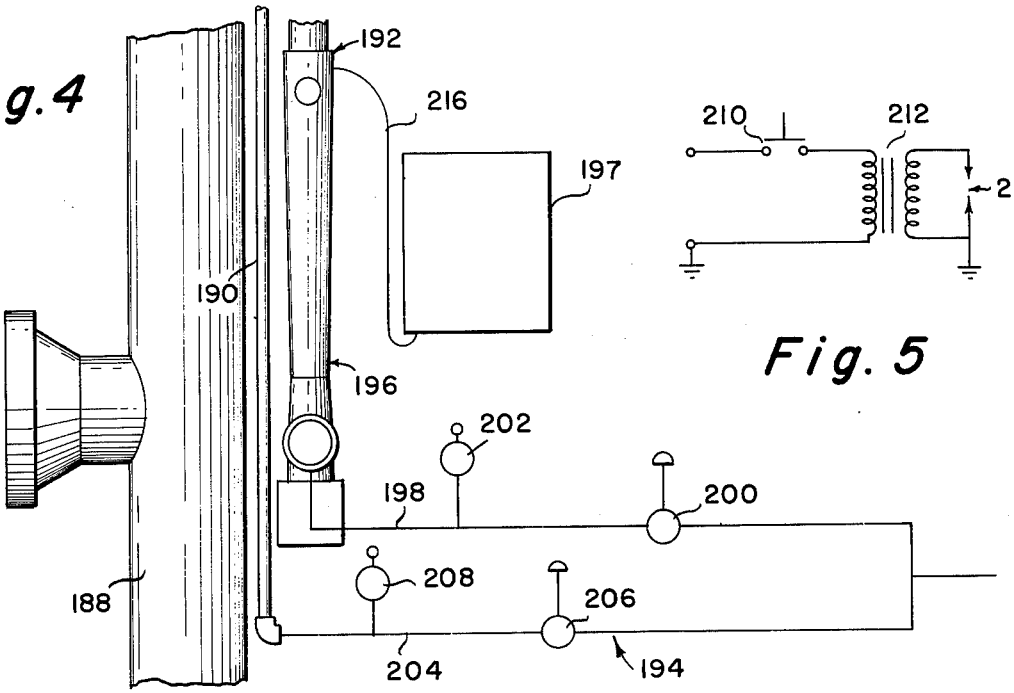
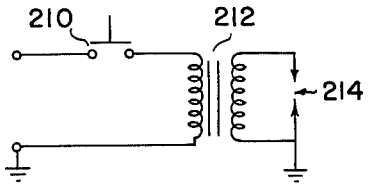
Fig. 5
Fig. 6
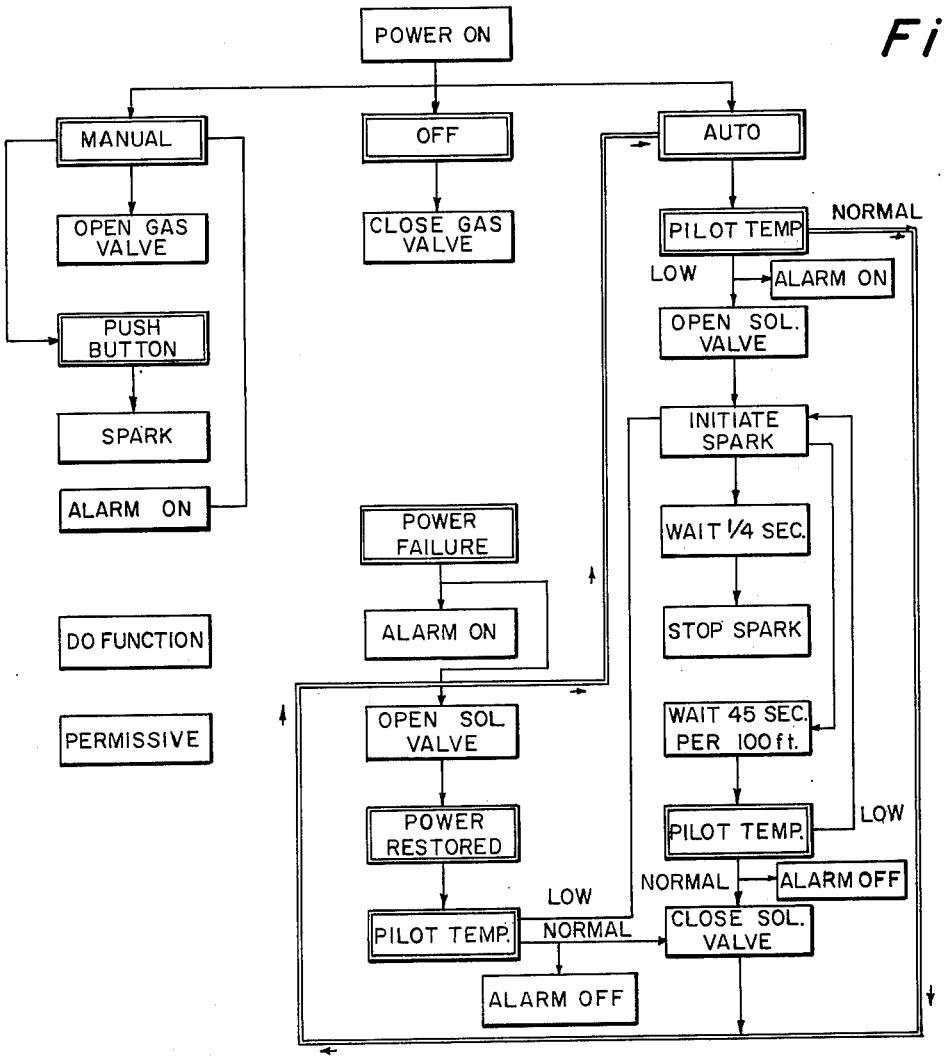

METHOD AND APPARATUS FOR FLARING COMBUSTIBLE WASTE GASES

BACKGROUND OF THE INVENTION

Flare stacks are used quite extensively especially in the petroleum refining industry for the burning of combustible waste gases produced as a by-product of the refining process. This is necessary because the gases pose both a safety hazard from the standpoint of explosion and fire as well as a health hazard in the form of atmospheric pollution.

Although the flare stacks may be operated continuously, intermittent operation is more common because the waste gases are produced in varying quantities at different times thereby making it difficult to maintain a constant flow of gas through the flare stack. To assure that these intermittently produced waste gases will be ignited, it is commonplace to provide a continuously burning pilot in the vicinity of the discharge end of the flare stack. Although the pilot is intended to burn continuously, it will often be blown out by winds of high velocity which are quite prevalant at the elevation of the pilot. Furthermore, repairs and routine maintenance of the flare stack and igniting system will require that the pilot be extinguished and then subsequently reignited when normal operation is resumed. For this reason, means must be provided to rapidly and safely reignite the pilot in the event of this accidental or intended extinguishment.

The prior art is replete with various apparatus and methods for igniting the pilot burner, including the raising of a burning torch on a cable, firing a flare or tracer bullet in the vicinity of the pilot burner, and activating a sparking device which is mounted within the pilot burner itself. Another method is to provide a vertical ignition tube adjacent the pilot, flowing a combustible gas through the ignition tube and igniting same within the tube itself to produce a flame front which travels upwardly and out of the ignition tube to thereby ignite the pilot. In apparatus of this last mentioned type it is desirable to provide the pilot with a venturi or other adjustable air-gas mixing devices to assure that the mixture is proper for efficient and safe operation of the pilot over long periods of time. It is also necessary that the igniting tube be provided with an adjustable air-gas mixing device such a venturi or the like because the manner in which the flame front is initiated and propagated within the tube is highly dependent on the richness or leanness of the mixture as well as its rate of flow. Furthermore, in extremely cold climates, the ignition tube must be of sufficiently large diameter to assure that the flame front will not be extinguished before it has reached the discharge nozzle.

OBJECTS OF THE INVENTION

It is an object of this invention to provide apparatus for flaring combustible waste gases including a burner assembly having an air-gas mixing device associated therewith thereby permitting it to perform the dual function of the ignition tube and the continuously burning pilot.

It is further object of this invention to provide an apparatus for flaring combustible waste gases wherein all moving parts and devices which require an adjustment are located at the base of the stack or are otherwise conveniently located at a point removed from the burners.

A further object of this invention is to provide an apparatus for flaring combustible waste gases including a fully automatic ignition system for reigniting the pilot in the event it is extinguished.

A still further object of this invention is to provide apparatus for flaring combustible waste gases wherein an adjustable air-gas mixture is provided for both ignition and pilot burner operation.

Another object of this invention is to provide an apparatus for flaring combustable waste gases wherein a minimum of large diameter piping is utilized without sacrificing efficiency, thereby resulting in a flare ignition system which is economical to operate and maintain.

Yet another object of this invention is to provide an apparatus for flowing combustible waste gases which may be operated without compressed air.

These and other objects will be apparent from a reading of the detailed description with reference to the appropriate drawings.

SUMMARY OF THE INVENTION

The invention relates to apparatus for flaring combustable waste gases comprising in combination: a vertical stack through which combustible waste gases may be discharged, a continuously burning pilot assembly mounted adjacent the stack, the pilot assembly comprising:

- a first tube having a vertical portion in substantially parallel and co-extensive spatial relationship with the stack,
- the first tube having an outlet on its upper end in close proximity to the discharge end of the stack and an inlet on its other end,
- a continuous flame nozzle connected to the outlet of the first tube,
- a mixing device in fluid communication with the inlet of the first tube for mixing air and a combustible fuel and introducing same into the first tube, a source of combustible fuel connected to the mixing means, temporary flame retention means comprising:

- a second tube having a vertical portion mounted adjacent the first tube and having an outlet in close proximity to the continuous flame nozzle,
- a flame retention nozzle on the last mentioned outlet, a source of combustible fuel connected to the lower end of the second tube, and momentary igniter means for igniting the mixture of combustible fuel and air produced by the mixing device, the igniter means being positioned within the lower portion of the first tube downstream from the mixing device.

A further aspect of the invention relates to a method for igniting combustible waste gas in a system including a vertical flare stack, a continuously burning pilot burner having an elongated ignition tube, and a flame retention burner in close proximity to the pilot burner, the method including the following steps: flowing a combustible gas through the flame retention burner, flowing a combustible air/gas mixture through the pilot burner, igniting the air/gas mixture within the ignition tube of the pilot burner at a point near ground level thereby causing a flame front to travel up the pilot burner to a continuous flame nozzle and igniting the combustible gas flowing from the flame retention nozzle, purging the spent air/gas mixture from the pilot burner by flowing combustible air/gas mixture therethrough until same is ignited by the flame produced at the flame retention nozzle, and subsequently discontinuing the flow of gas through the flame retention burner to extinguish the flame at the flame retention nozzle.

BRIEF DESCRIPTION OF THE DRAWINGS

FIG. 4 is fragmentary side elevational view of the manual ignition embodiment of the present invention;

FIG. 5 is a schematic of the electrical circuit forming a portion of the embodiment illustrated in FIG. 4;

FIG. 6 is a view showing schematically the automatic ignition sequence; and

DETAILED DESCRIPTION OF THE DRAWINGS

A flare stack is shown at 10 which includes a flare gas inlet 12 and is adapted to be mounted vertically so that its discharge end 14 is located at an elevation normally in excess of 200 feet depending upon the requirements imposed by safety consideration in view of neighboring building, aircraft traffic, etc. In a known manner, waste gas produced by the refining of petroleum or other processes is introduced into the stack through inlet 12 and caused to flow upward whereupon it is discharged at 14. Depending upon the requirements of a particular installation, the flare stack 10 may be provided with a burner (not shown) which is located on its discharge end 14.

Figures 1, 2:
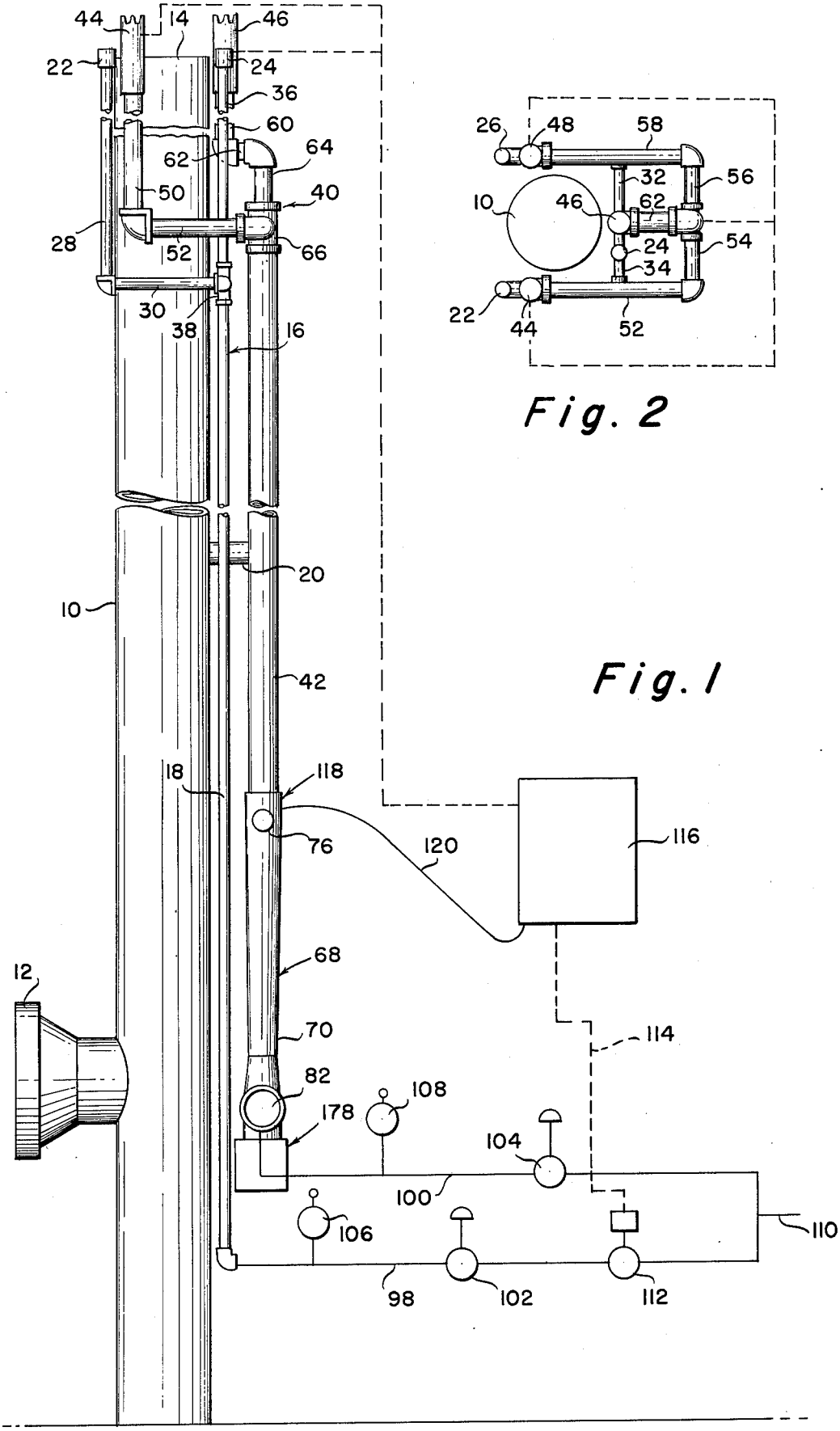
FIG. 1 is side elevational view of the invention with a portion thereof shown diagrammatically.
FIG. 2 is a top plan view of the flare stack and igniter assembly illustrated in FIG. 1.

Adjacent the flare stack 10 and rigidly mounted thereto is the flame retention burner assembly indicated generally as 16. The assembly 16 comprises one or more lengths of tubing or pipe 18, a plurality of flame retention nozzles 22, 24 and 26 supported by risers 28 and 36 and connecting pipes 30, 32 and 34 as illustrated in FIG. 1. Connecting pipes 30, 32 and 34 are connected to pipe 18 through four-way connector 38. Preferably, pipes 18, 30, 32 and 34 and risers 28 and 36 are made of heavy guage metal having an internal diameter of approximately 1 inch. Pipe 18 may be supported vertically by welding or bolting it to bracket 20 which in turn is welded to stack 10.

Also mounted vertically adjacent stack 10 is the continuous burning pilot assembly 40 which comprises one or more lengths of pipe 42 which is welded or otherwise secured to bracket 20, a plurality of deep burning continuous flame nozzles 44, 46 and 48 which are supported by risers 50 and 60 and interconnecting pipes 52, 54, 56, 58, 62 and 64 as illustrated in FIG. 1. Pipes 52, 54, 56, 58, 62 and 64 are connected to tube 42 through four-way connector 66. Risers 50 and 60 and pipes 52, 54, 56, 58, 62 and 64 are typically 2 inches in diameter and pipe 42 is preferably 3 inches in diameter. It should be noted that the inner diameter of pipe 42 is of considerable importance especially in colder climates because it must be sufficiently large to support the propagation of the flame front for long distances. This is a problem because of the fact that at low temperatures, the pipe 42 will tend to conduct heat away from the traveling flame thereby extinguishing it. Nozzles 44, 46 and 48 are of the continuous flame type which are deep burning and therefore are not easily extinguished by wind or inclement weather.

Figure 3:
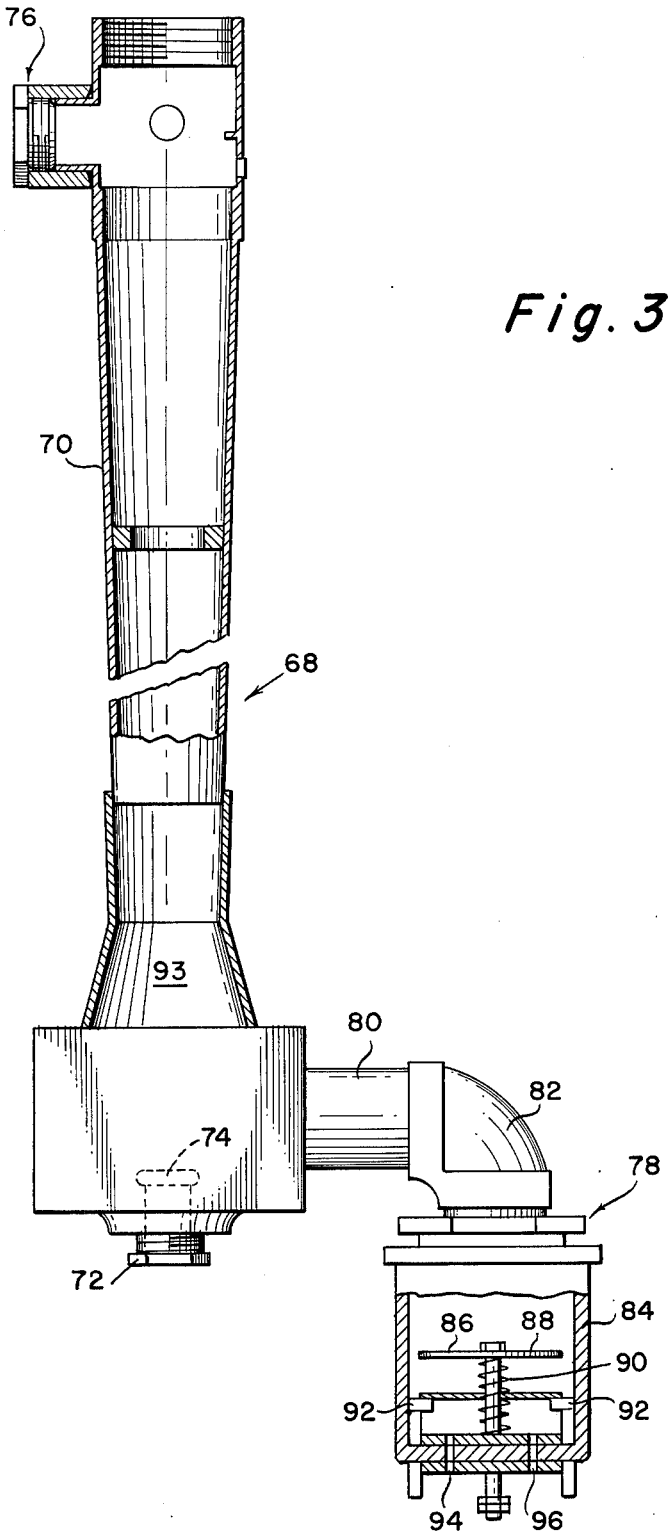
FIG. 3 is an enlarged sectional view of the venturi and flashback preventer forming a portion of the present invention.

Referring to FIGS. 1 and 3, pipe or tube 42 is threadedly connected to inspirator venturi 68 which comprises a casing 70, a gas inlet 72, a gas nozzle 74 and a sight port 76. Venturi 68 is also provided with a flashback preventer 78 connected thereto through nipple 80 and elbow 82. Flashback preventer 78 comprises a casing 84, diaphragm 86 supported on bolt 88 and spring 90 and an annular seat 92. By virtue of spring 90, diaphragm 86 has a normally open position as shown in FIG. 3 thereby permitting air to be drawn into the throat portion 93 of venturi 68 through openings such as 94 and 96 in casing 84. Upon ignition of the combustible air-gas mixture, a flame front and shock wave will be generated which will travel down through nipple 80 and elbow 82 thereby urging diaphragm 86 downwardly against the resistence of spring 90 to prevent the emergence of the flame through air inlet openings 94 and 96.

The supply of gas to pipe 18 and gas inlet 72 is provided through gas lines 98 and 100, respectively, the flow rate of which is controlled by means of valves 102 and 104. Pressure gauges 106 and 108 render an indication of the pressure at the inlets to pipe 18 and venturi 68. Line 110 is connected to a separate source of combustible gas such as methane, butane or any other suitable hydrocarbon gas. The flow of gas within line 98 may be interrupted completely by means of solenoid valve 112 which is controlled through electrical line 114 by means of automatic ignition panel 116. As will be described in further detail below, panel 116 produces an electrical impulse which is transmitted to a spark plug or other spark generating device located within the upper portion 118 of venturi 68 through electrical line 120.

Figure 7:
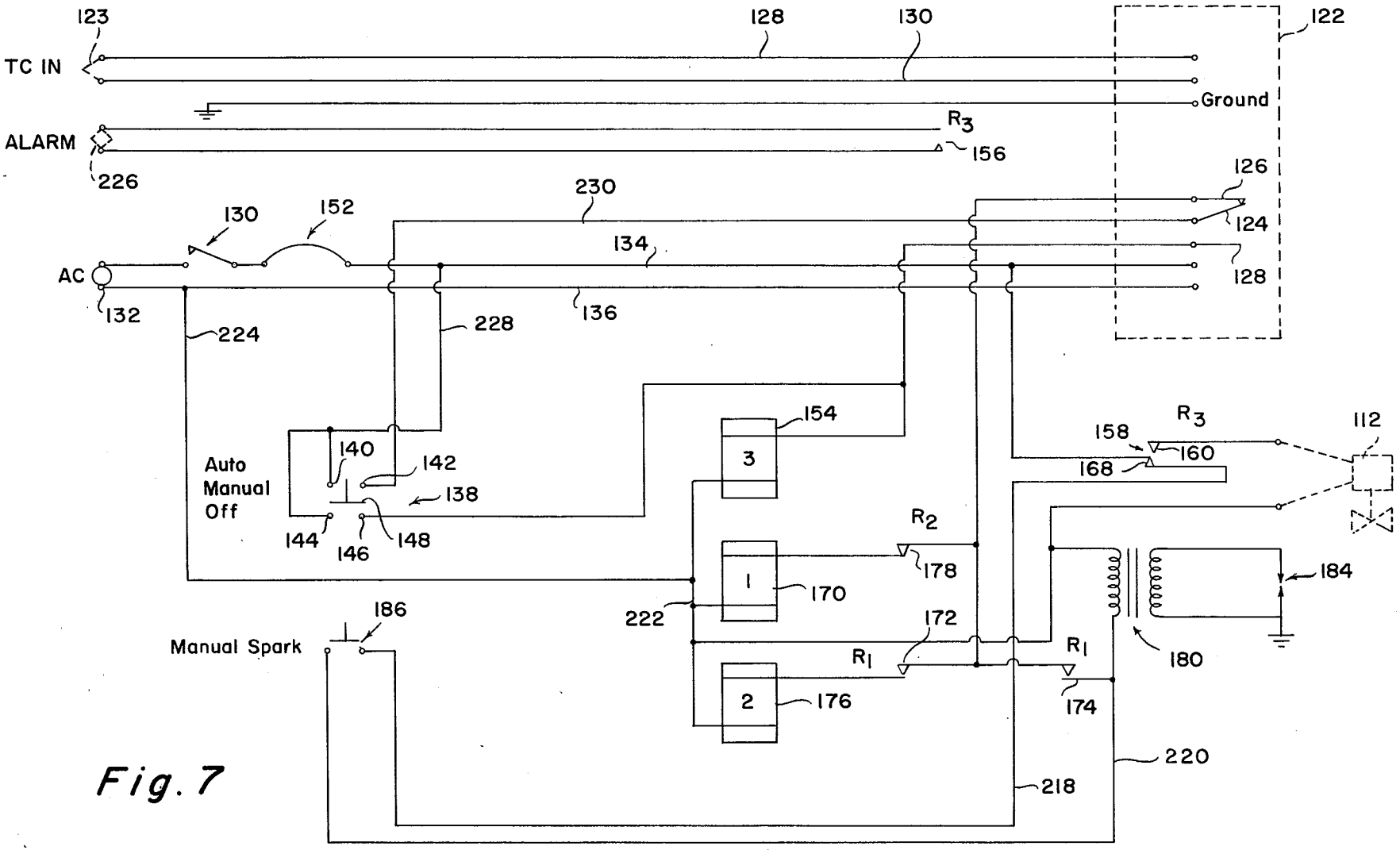
FIG. 7 is an electrical schematic representing the automatic ignition circuit.

The automatic ignition circuit housed within panel 116 is illustrated in FIG. 7. The thermocouple controller shown generally as 122 receives an input signal from one or more thermocouples 123 which are mounted within continuous flame nozzles 44, 46 and 48 and, depending upon the signal therefrom, move wiper 124 between contacts 126 and 128. Although the details of controller 122 are not shown, adjustable thermocouple controllers of this type are well known to the skilled artisan and are readily available on the market. Simply stated, its function is to switch wiper 124 from one contact to the other in relation to the temperature dependent signal on lines 128 and 130. The thermocouple inputs are transmitted to controller 122 on lines 128 and 130 and the power input from AC source 132 on lines 134 and 136. A three-way switch 138 includes contacts 140 and 142 in the AUTO position and contacts 144 and 146 in the OFF position. In the MANUAL position, movable switch contact 148 is in an open position between contacts 140, 142 and 144, 146. A power toggle switch 130 permits all power to be disconnected from the circuit and fuse 152 prevents damage to the electrical equipment due to excessive current flow. Relay 154 controls two sets of contacts 156 and 158, the latter having a pair of alternatively closed contacts 160 and 168 such that it functions in a two-pole switch. Relay 170 is a time delay relay having two pairs of contacts 172 and 174 which close after a predetermined period of time following the energization of relay 170. Relay 176 is also a time delay relay having a single pair of contacts 178 which open after a predetermined period of time following the energization of relay 176.

Transformer 180 steps up the voltage across coil 182 to cause a spark to be generated by spark plug 184. This spark may be manually generated by depressing momentary push button switch 186.

In addition to the automatic ignition apparatus described in conjunction with FIGS. 1, 2, 3, 6 and 7, a manual ignition apparatus has been illustrated in FIGS. 4 and 5. The manual apparatus is quite similar to the automatic system and comprises a flare stack 188, a flame retention burner assembly 190. a pilot assembly 192, a gas supply system 194 and a manual ignition panel 197. Venturi 196 is supplied with gas through line 198, the flow rate of which is controlled by a valve 200 and the pressure of which is monitored by gauge 202. Flame retention assembly 190 is supplied with gas from the same source as line 180 through line 204, the flow rate of which is manually controlled by valve 206 and the pressure of which is monitored by means of gauge 208. Two primary distinctions between the automatic system shown in FIGS. 1, 2, 3, 6 and 7 and the manual system illustrated in FIGS. 4 and 5 are the absence of a solenoid controlled valve for shutting off the flow of gas in line 204 and the absence of thermocouples in the continuous flame nozzles (not shown). Also, the ignition circuit is much simpler and comprises a manually operated momentary push button switch 210, a voltage step up transformer 212 and a spark plug 214, the latter being positioned within the upper portion of venturi 196 and connected to panel 197 through electrical line 216. The continuous flame and flame retention nozzles for the manual system of FIG. 4, although not shown, are identical to those illustrated in FIGS. 1 and 2.

OPERATION

The operation of the automatic ignition circuit will now be described with reference to the logic diagram shown in FIG. 6 and the structural features shown in FIGS. 1, 2, 3 and 7.

Prior to operating the ignition system in automatic mode, valves 102 and 104 should be adjusted to provide the desired flame at the flame retention nozzles 22, 24 and 26 and to achieve the proper detonation of the air-gas mixture within pipe 42. To do this, toggle switch 130 is closed and switch 138 is moved to the MANUAL position thereby supplying power to thermocouple controller 122 through AC lines 134 and 136. Power is supplied to manual spark switch 186 through lines 216, contacts 168, line 218, line 220, coil 182, line 222 and line 224. In this state, contacts 156 are open thereby actuating alarm 226. Since relay 154 is not energized, contacts 158 are in their normal position with contact 160 open thereby opening solenoid valve 112 and permitting gas to flow through line 98. Thermocouple controller 122 is set to the appropriate level (e.g. 500° F.) and relay 176 is adjusted so that the time delay has a duration equal to the following expression:

$$\frac{\text{stack height}}{\text{100 feet}} \times 45 \text{ seconds} = \text{time delay}$$

Relay 170 is also set to have a time delay of 174 second duration which is sufficient to produce a spark across the electrodes of spark plug 184. Valves 102 and 104 are then opened and gas is permitted to flow through flame retention line 16 and pilot burner assembly 118 for a period of time equal to the time delay relay of relay 176 thereby purging the system of non-combustible gases. Switch 186 is then momentarily depressed causing spark plug 184 to spark and igniting the air-gas mixture within pipe 42. If the detonation is soft or mellow, the mixture is rich and if the detonation is sharp or violent the mixture is lean. The desired mixture is that which is "slightly rich" and the venturi gas supply valve 102 is adjusted to achieve this condition. Again allow the system to purge for the time delay set into relay 176 and then ignite the gas within pipe 42. Note the time taken for the flame front to reach the continuous flame nozzles 44, 46 and 48 and then readjust relay 176 so that the set time is slightly longer than the time required for the flame front to reach the top.

Now that the automatic ignition system is properly adjusted, it may be placed in an inactive state by moving switch 138 to the OFF position. In this position, power is supplied to thermocouple controller 122 and relay 154 thereby closing contacts 160 and 156 which causes solenoid valve 112 to close and alarm 226 to deactivate.

Move switch 138 to the AUTO position and assume that the continuous flame nozzles 44, 46 and 48 have not been ignited and are in a "low temperature" state. By moving switch 138 to the AUTO position, power is supplied to thermocouple controller 122 through lines 134 and 136 and the receipt of a low temperature signal from the thermocouple on lines 128 and 130 causes wiper 124 to move into contact with 126 thereby deenergizing relay 154. When relay 154 is deenergized, contacts 156 open there by actuating the alarm and contacts 168 close thereby deenergizing solenoid controlled valve 112 causing it to open and permit gas to flow in line 98. Power is supplied to relay 170 through line 228, switch contacts 140 and 142, line 230, wiper 124, contact 126, line 232, contacts 178 and line 224 thereby causing it to energize allowing power to flow through coil 182 for the time duration set on relay 170. This causes spark plug 184 to ignite the air-gas mixture within pipe 42 thereby creating a flame front which travels upward through pipe 42 to connector 66 whereupon three flame fronts are produced which travel simultaneously through pipes 54, 52, 56, 58, 64 and 62 and up through risers 50 and 60 and the riser (not shown) for continuous flame nozzle 48. As the momentary flame emerges from continuous flame nozzles 44, 46 and 48, the raw gas flowing from flame retention nozzles 22, 24 and 26 is ignited and they remain burning until extinguished.

Returning again to the electrical schematic shown in FIG. 7, when relay 170 is energized, contacts 172 and 174 are closed for the present time (usually ¼– ½ second) thereby permitting the energization of relay 176. As relay 176 energizes, normally closed contacts 178 open thereby deenergizing relay 170. Since valve 104 is open, gas continues to flow through pilot assembly 40 thereby purging the spent gas produced as the flame front traveled upward through pilot assembly 40 and out continuous flame nozzles 44, 46 and 48. When the pilot assembly is completely purged and the combustible air-gas mixture flows from nozzles 44, 46 and 48, it is reignited by virtue of the flame present at flame retention nozzles 22, 24 and 26.

If the time duration set into relay 176 is slightly longer than the time necessary for the purging operation and the continuous flame nozzles 44, 46 and 48 have been reignited, after the relay 176 time delay, wiper 124 in thermocouple controller 122 will trip completing the circuit with contact 128 and breaking the circuit with contact 126 thereby deenergizing relays 170 and 176 and energizing relay 154. Upon the energization of relay 154, contacts 160 will close energizing solenoid valve 112 causing it to close and interrupt the flow of raw gas through line 98 and flame retention burner assembly 16 thereby extinguishing the flames present at nozzles 22, 24 and 26. Additionally, contacts 156 will close to deactivate alarm 226. At this time, continuous flame nozzles 44, 46 and 48 continue to burn so that any waste gas which is discharged through stack 10 will be ignited.

If, after pilot assembly 40 purged, continuous flame nozzles 44, 46 and 48 are not ignited, a low temperature signal will still be received at thermocouple controller 122 and wiper 124 will remain in the position illustrated in FIG. 7, i.e. completing the circuit with contact 126. With this condition present in thermocouple controller 122, the degenergization of relay 176 will close contacts 178 thereby energizing relay 170 which initiates the sequence of events causing sparking of device 184, the purging of pilot assembly 40 and the resensing of the thermocouple temperature within continuous flame nozzles 44, 46 and 48.

This sequence will continue until such time as nozzles 44, 46 and 48 are ignited and remain burning. In this condition, a "temperature normal" signal will be received at by thermocouple controller 122 and wiper 124 will trip and move into contact with 128 thereby energizing relay 154. This will close contacts 156 deactivating alarm 226 and will close contacts 160 closing solenoid valve 112 thereby extinguishing flame retention nozzles 22, 24 and 26.

In the event of a power failure, relay 154 will deenergize and alarm contacts 156 will open thereby giving an alarm. Since contacts 160 will also open, solenoid valve 112 will open permitting gas to flow through flame retention burner assembly 16 and the flame retention nozzles 22, 24 and 26 will be ignited thereby functioning as standby pilots. When power is restored, the system will function as described above for either the "temperature low" or temperature normal condition.

By virtue of the above operation of the automatic ignition system, there is virtual assurance that the pilot burners 44, 46 and 48 will always remain lit or will be quickly reignited should they be extinguished by wind, inclement weather, etc. Even in the event of a power failure, the flame retention nozzles are ignited to act as a backup.

The manual ignition system illustrated in FIGS. 4 and 5 operates in a similar fashion to the automatic system previously described, the main distinction being that all sequencing must be done manually. To ignite the continuous flame nozzles which may be identical in construction to those described in conjunction with FIG. 1, valves 206 and 200 are adjusted to properly regulate the flow of gas through flame retention line 190 and pilot burner assembly 192. After allowing the system to purge for 45 seconds per 100 feet of vertical stack height, the sparking device located within the upper portion of venturi 196 is activated thereby detonating the mixture within pilot burner assembly 192 and producing a flame front which travels upwardly and out of the continuous flame nozzles thereby lighting the flame retention nozzles (not shown) which may be identical in construction to those described in conjunction with FIG. 1. After the pilot burner assembly has purged itself, the continuous flame nozzles will be reignited and the flame retention nozzles may be extinguished by closing the valve 206. In the event that the continuous flame nozzles are extinguished, this sequence must be repeated until such time as they are successfully relit.

It should be noted that any number of continuous flame nozzles and flame retention nozzles may be employed, although more than one is normally preferable to ignite that flare stack under high wind conditions.

While this invention has been described as having a preferred design, it will be understood that it is capable of further modification. The application is, therefore, intended to cover any variations, uses or adaptations of the invention following the general principles thereof and including such departures from the present disclosure as has come within known or customary practice in the art to which this invention pertains, and as may be applied to the essential features hereinbefore set forth and fall within the scope of this invention or the limits of the appended claims.

What is claimed is:

1. Apparatus for flaring combustible waste gases comprising in combination:

a vertical stack through which combustible waste gases may be discharged, said stack having a base, a continuously burning pilot assembly mounted adjacent said stack, said pilot assembly comprising:

a vertical tube in substantially parallel and coextensive spatial relationship with said stack, said tube having a base near the base of said stack, said vertical tube having an outlet on its upper end in close proximity to the discharge end of said stack and an inlet near its base, a continuous flame nozzle on the outlet of said vertical tube, a venturi in fluid communication with the inlet of said vertical tube for mixing air and a combustible raw gas and introducing same into said vertical tube, said venturi being located near the base of said vertical tube, a source of combustible raw gas connected to said venturi, a temporary burner mounted adjacent said vertical tube and having a flame retention nozzle in close proximity to said continuous flame nozzle, a source of combustible raw gas connected to said temporary burner, momentary igniter means for igniting the mixture of combustible raw gas and air produced by said venturi, said igniter means being positioned within said vertical tube near the base thereof downstream from said venturi, and independently controlled first and second valve means for regulating the flow of combustible raw gas to said venturi and said temporary burner.

2. The apparatus of claim 1 and wherein said mixing means comprises an inspirator venturi having an air inlet and a raw gas inlet.

3. The apparatus of claim 2 and including a flashback preventer in said air inlet.

4. The apparatus of claim 1 and wherein said igniter means is a spark producing device.

5. The apparatus of claim 1 and including a plurality of said continuous flame nozzles and said flame retention nozzles.

6. Apparatus for flaring combustible waste gases comprising in combination:

a vertical stack through which combustible waste gases may be discharged, a continuously burning pilot assembly mounted adjacent said stack, said pilot assembly comprising:

a first tube having a vertical portion in substantially parallel and co-extensive spatial relationship with said stack, said first tube having an outlet on its upper end in close proximity to the discharge end of said stack, and an inlet on its other end, a continuous flame nozzle connected to the outlet of said first tube, mixing means in fluid communication with the inlet of said first tube for mixing air and a combustible fuel and introducing same into said first tube, a source of combustible fuel connected to said mixing means, temporary flame retention means comprising:

a second tube having a vertical portion mounted adjacent said first tube and having an outlet end in close proximity to said continuous flame nozzle, a flame retention nozzle on said last mentioned outlet end, a source of combustible fuel connected to the lower end of said second tube, and momentary igniter means for igniting the mixture of combustible fuel and air produced by said mixing means, said igniter means being positioned within the lower portion of said first tube downstream from said mixing means, independently controlled first and second valve means for regulating the flow of combustible fuel into said mixing means and said second tube, means for sensing the temperature at said continuous flame nozzle and comparing this temperature with a preset temperature valve, means for opening said second valve means to permit the flow of fuel through said gas retention nozzle when said temperature at said continuous flame nozzle is lower than said preset temperature value, means for activating said igniter means after said second valve means is opened, means for closing said second valve means after a preset minimum period of time, and means for disabling said means for closing said second valve means when said temperature at said continuous flame nozzle is above said preset temperature.

7. In a system for burning waste gas including a vertical flare stack, a pilot burner having a continuous flame nozzle in close proximity to the discharge outlet of the stack and an elongated tube connecting the nozzle with a supply of combustible air/gas mixture or near ground level, and a flame retention burner having a flame retention nozzle in close proximity to said continuous flame nozzle and an elongated tube connecting the continuous flame nozzle to a supply of combustible gas at or near ground level, a method for igniting the waste gas which is discharged from the stack comprising the steps of:

flowing a combustible gas through the flame retention burner, flowing a combustible air/gas mixture through the pilot burner, igniting the air/gas mixture within the elongated tube of the pilot burner at a point near ground level thereby causing the flame front to travel up the pilot burner tube to the continuous flame nozzle and igniting the combustible gas flowing from the flame retention nozzle, purging the spent air/gas mixture from the pilot burner by flowing a combustible air/gas mixture therethrough until same is ignited by the flame produced at the flame retention nozzle, and subsequently discontinuing the flow of gas through the flame retention burner to extinguish the flame at the flame retention nozzle.

8. The method of claim 7 wherein the combustible air/gas mixture flowing through the pilot burner is produced by an inspirator venturi.

9. The method of claim 7 wherein the igniting of the air/gas mixture within the pilot burner tube is accomplished by means of a spark.

10. In a system for burning waste gas including a vertical flare spark, a pilot burner having a continuous flame nozzle in close proximity to the discharge outlet of the stack and an elongated tube connecting the nozzle with a supply of a combustible at or near ground level, and a flame retention burner having a flame retention nozzle in close proximity to said continuous flame nozzle and an elongated tube connecting the continuous flame nozzle to a supply of combustible gas at or near ground level, a method for igniting the waste gas which is discharged from the stack comprising the steps of:

a. flowing a combustible gas through the flame retention burner, b. flowing a combustible air/gas mixture through the pilot burner, c. automatically sensing the temperature within the continuous flame nozzle and comparing the sensed temperature to a preset temperature, d. if the sensed temperature is lower than the preset temperature, flowing gas through the flame retention burner and igniting the air/gas mixture within the elongated tube of the pilot burner at a point near ground level thereby causing the flame front to travel up the pilot burner tube to the continuous flame nozzle and igniting the combustible gas flowing from the flame retention nozzle, e. continuing to flow the combustible air/gas mixture through the pilot burner for a period of time sufficient to purge the spent gas and cause reignition of the purging air/gas mixture as it flows from the continuous flame nozzle, f. after a predetermined adjustable period of time sufficient to purge the pilot burner, again automatically sensing the temperature within the continuous flame nozzle and comparing this sensed temperature to the present temperature, g. if the sensed temperature is equal to or greater than the present temperature, discontinuing the flow of gas through the flame retention burner to extinguish the flame at the flame retention nozzles, h. if the sensed temperature is lower than the preset temperature, performing steps (d) through (g) until the sensed temperature is higher than the present temperature.

11. Apparatus for igniting a flare stack comprising:

a continuously burning pilot including a vertical ignition tube connecting with a continuous flame nozzle and adapted to convey a combustible air-gas mixture, momentary igniter means within said ignition tube for igniting the combustible air/gas mixture therein and causing a flame front to be propagated to said continuous flame nozzle, a vertical flame retention burner having a nozzle in close proximity to said continuous flame nozzle, said pilot burner and said flame retention burner being connected to a source of combustible gas, valve means assoicated with said flame retention burner for interrupting the flow of gas through same, controller means for sensing the temperature at the continuous flame nozzle, comparing this temperature with a reference temperature and causing a two position switch device to assume a first position if the sensed temperature is equal to or greater than the reference temperature and to assume a second position if the sensed temperature is less than the reference temperature, first means operatively connected to said controller means when in said first position for closing said valve means, second means operatively connected to said controller means when in said second position for opening said valve means and activating said igniter means to explode the combustible air/gas mixture within said ignition tube, said second means further including means for closing said valve means after a preset period of time following the activation of said igniter means if said controller means has switched to and remained in said second position.

* * * * *